US008144901B2

(12) United States Patent
Tsuiki et al.

(10) Patent No.: US 8,144,901 B2
(45) Date of Patent: Mar. 27, 2012

(54) SOUND IMAGE POSITION CORRECTION SYSTEM, SOUND IMAGE POSITION CORRECTION METHOD, AND AUDIO/DISPLAY APPARATUS

(75) Inventors: Hayato Tsuiki, Kanagawa (JP); Teiichi Shiga, Chiba (JP); Koji Miura, Tokyo (JP)

(73) Assignee: Sony Corporation, Tokyo (JP)

( * ) Notice: Subject to any disclaimer, the term of this patent is extended or adjusted under 35 U.S.C. 154(b) by 1209 days.

(21) Appl. No.: 11/454,009

(22) Filed: Jun. 16, 2006

(65) Prior Publication Data

US 2006/0291665 A1 Dec. 28, 2006

(30) Foreign Application Priority Data

Jun. 24, 2005 (JP) ..... 2005-185593

(51) Int. Cl.
*H04R 5/02* (2006.01)

(52) U.S. Cl. ..... 381/306; 381/388; 381/333

(58) Field of Classification Search ..... 381/310, 381/386, 395, 17, 18, 1, 27, 300, 303, 307, 381/306, 333, 388; 181/175, 198, 199; 345/158, 345/169

See application file for complete search history.

(56) References Cited

U.S. PATENT DOCUMENTS

| | | | | |
|---|---|---|---|---|
| 5,838,537 | A * | 11/1998 | Lundgren et al. | 361/679.27 |
| 6,292,358 | B1 * | 9/2001 | Lee et al. | 361/679.23 |
| 2006/0161278 | A1 * | 7/2006 | Maeda et al. | 700/94 |

FOREIGN PATENT DOCUMENTS

| | | | |
|---|---|---|---|
| JP | 1-123953 | | 8/1989 |
| JP | 5-23693 | | 3/1993 |
| JP | 5-344600 | | 12/1993 |
| JP | 6-105390 | | 4/1994 |
| JP | 6-233377 | | 8/1994 |
| JP | 06-233377 | * | 8/1994 |
| JP | 10-243489 | * | 9/1998 |
| JP | 11-113099 | * | 4/1999 |
| JP | 2000-125400 | | 4/2000 |
| JP | 2001-016700 | * | 1/2001 |
| JP | 2001-16700 | | 1/2001 |
| JP | 2002-10400 | | 1/2002 |
| JP | 2003-244786 | * | 8/2003 |
| JP | 2005-295382 | | 10/2005 |

* cited by examiner

*Primary Examiner* — Xu Mei
*Assistant Examiner* — Lun-See Lao
(74) *Attorney, Agent, or Firm* — Oblon, Spivak, McClelland, Maier & Neustadt, L.L.P.

(57) ABSTRACT

The present invention provides a sound image position correction system that applies sound image position correction processing to a voice signal so that an optimal sound image position is obtained. There is provided a sound image position correction system which corrects the position of a sound image output from a plurality of speakers in a multichannel reproduction system having three or more channels, which includes a speaker moving section that moves the positions of the plurality of speakers provided in the multichannel reproduction system, a speaker position detection section that detects the positions of the plurality of speakers moved by the speaker moving section, and a sound image position correction section that applies sound image position correction processing to a sound signal to be supplied to the plurality of speakers based on the positions of the speakers detected by the speaker position detection section.

20 Claims, 7 Drawing Sheets

SOUND IMAGE POSITION CORRECTION SYSTEM, SOUND IMAGE POSITION CORRECTION METHOD, AND AUDIO/DISPLAY APPARATUS

CROSS REFERENCES TO RELATED APPLICATIONS

The present invention contains subject matter related to Japanese Patent Application JP 2005-185593 filed in Japanese Patent Office on Jun. 24, 2005, the entire contents of which being incorporated herein by reference.

BACKGROUND OF THE INVENTION

1. Field of the Invention

The present invention relates to a sound image position correction system that corrects the position of a sound image output from a plurality of speakers in a multichannel reproduction system having three or more channels.

2. Description of the Related Art

As a medium capable of reproducing multichannel having three or more voice channels which are independent of one another, SACD (Super Audio Compact Disc), DVD (Digital Versatile Disc or Digital Video Disc), and the like have been standardized.

For example, in a 5.1 ch surround system which has been developed for creating sound effect that makes a scene alive in a movie theater, six speakers (speakers placed in the front, right-front, left-front, right-rear, left-rear of audience, and subwoofer speaker for bass sounds (in general, placed in the front of audience)) are used to create a special and real sound environment.

As described above, a 5.1 ch surround system in which six speakers (speakers placed in the front, right front, left front, right rear, left rear of audience, and subwoofer speaker for bass sounds (in general, placed in the front of audience)) are used to create a special and real sound environment has been known. Note that the subwoofer speaker can reproduce a limited range of sounds, so that it is counted as 0.1 channel.

In recent years, the 5.1 ch surround system has been applied to DVD-video or digital broadcasting.

In a system constituted only by real speakers, early-reflected sound and reverberant sound are generated from respective speakers placed in a horizontal plane in general, so that it is not possible to create reflected sound from above. However, three-dimensional (3D) sound processing using a DSP (Digital Signal Processor) allows creation of an environment where reproduction sound is heard as if it were output from the position different from the actual speaker position, thereby realizing virtual localization of a plurality of sound sources or controlling the position of a sound image to an arbitrary position in front of audience by virtually shifting the position of a sound image (refer to, for example, Patent Documents 1 and 2: Japanese Patent Application Laid-Open Publication No. 2001-16698 and No. 2004-135023)

Along with the popularization of an LCD display or the like, the thickness of a display unit of a TV set or the like has been reduced but the size thereof has been increased. Such a TV set is located in a conspicuous place in a room in general and serves also as a main interior furnishing item. Further, a display unit serving as a multiple function unit capable of reproducing/displaying video information recorded in various recording media with a large-sized screen has emerged.

Similarly, an audio unit having not only a function of reproducing a sound signal employed in the past but also having a multiple function has emerged. For example, such a multi-functioned audio unit is connected to a display unit to thereby powerfully reproduce a sound signal in accordance with a video image displayed on a large-sized screen of the display unit. Accordingly, there is an increasing demand that a display unit and audio unit are combined to serve as so-called a multiple function unit, that is, an audio/display apparatus.

SUMMARY OF THE INVENTION

A display unit, which is located in a conspicuous place in a room as described above, may impair the room atmosphere because the screen of the display unit stays black in a state where a video image is not reproduced. This problem becomes increasingly prominent as the screen becomes larger.

The above-described audio/display apparatus can provide a viewer with TV broadcast programs and recorded information stored in a recording medium with a video image displayed on a large-sized screen of a display unit and realistic sound output from an audio unit. With regard to the installation of the audio/display apparatus, a display unit is generally placed at a position corresponding to viewer's eye in terms of height, and speakers are set on both sides of the display so as to form a satisfactory sound field.

However, in the case where a user utilizes only the audio function of the audio/display apparatus, a large "black" screen of the display unit existing on the visual line of the user may impair the atmosphere. Further, since speakers are set on both sides of the display unit, the entire width of the audio/display apparatus increases as the display size increases. Therefore, in order to limit the size of the audio/display apparatus to some degree, it is necessary to limit the size of the display unit or the capability of the speaker.

In a multichannel sound reproduction system such as a home theater, a video display apparatus may be placed at a position lower than the position of speakers in some cases due to design. In this case, if the position of a sound image produced by a sound output is displaced from the display screen of the video display apparatus, a reproduction state becomes unnatural. Therefore, it is necessary to apply sound image position correction processing to a voice signal so that an optimal sound image position is obtained and maintained without being influenced by the speaker position.

In view of the problem described above, it is desirable to apply sound image position correction processing to a voice signal so that an optimal sound image position is obtained and maintained without being influenced by the speaker position in a multichannel reproduction system having three or more speakers converting a voice signal into a sound output.

The above and other purposes, advantages and features of the present invention will be more apparent from the following description taken in conjunction with the accompanying drawings.

According to an embodiment of the present invention, there is provided a sound image position correction system which corrects the position of a sound image output from a plurality of speakers in a multichannel reproduction system having three or more voice channels, including: a speaker moving means for moving the positions of the plurality of speakers provided in the multichannel reproduction system; a speaker position detection means for detecting the positions of the plurality of speakers moved by the speaker moving means; and a sound image position correction means for applying sound image position correction processing to a sound signal to be supplied to the plurality of speakers based on the positions of the speakers detected by the speaker position detection means.

In the sound image position correction system, the sound image position correction means applies sound image position correction processing only to sound signals of e.g., front-left and front-right channels.

A sound image position correction system according to the embodiment of the present invention is configured to correct the position of a sound image output from a plurality of speakers in a multichannel reproduction system having three or more voice channels. The system includes: a speaker moving means for moving the positions of the plurality of speakers provided in the multichannel reproduction system; a speaker position detection means for detecting the positions of the plurality of speakers moved by the speaker moving means; and a sound image position correction means for applying sound image position correction processing to a sound signal to be supplied to the plurality of speakers based on the positions of the speakers detected by the speaker position detection means. With the above configuration, it is possible to constantly set a sound image at the optimal position.

DETAILED DESCRIPTION OF THE PREFERRED EMBODIMENTS

An embodiment of the present invention will be described in detail below with reference to the accompanying drawings. It should be noted that the present invention is not limited to the following embodiment, and various modifications may be made without departing from the scope of the present invention.

Figure 1:
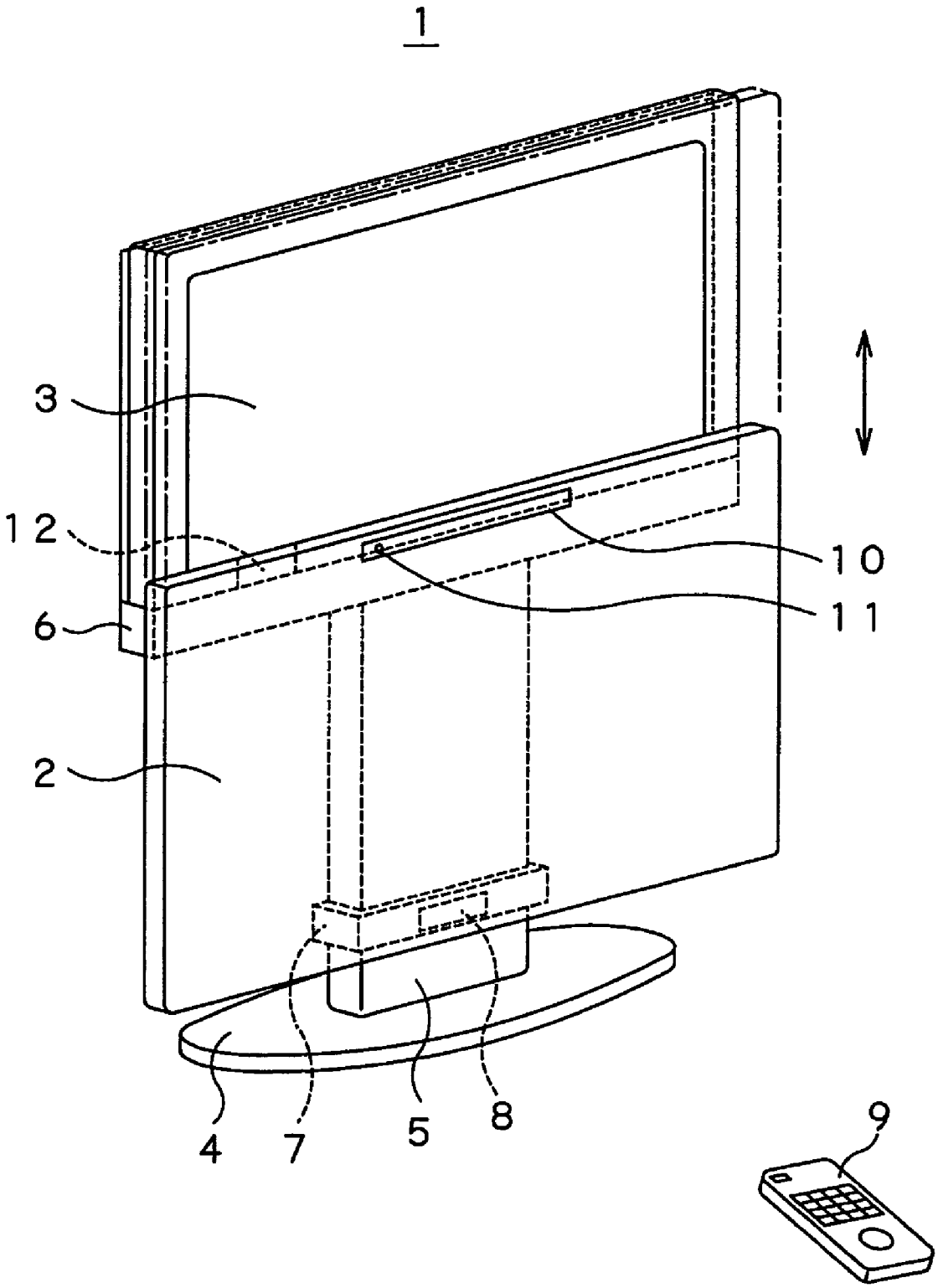
FIG. 1 is a perspective view of an audio/display apparatus according to an embodiment of the present invention, and which shows a first position state in which an audio unit has been moved down to expose an LCD.

The present invention is applied to, e.g., an audio/display apparatus 1 having a configuration as shown in FIG. 1.

Figure 2:
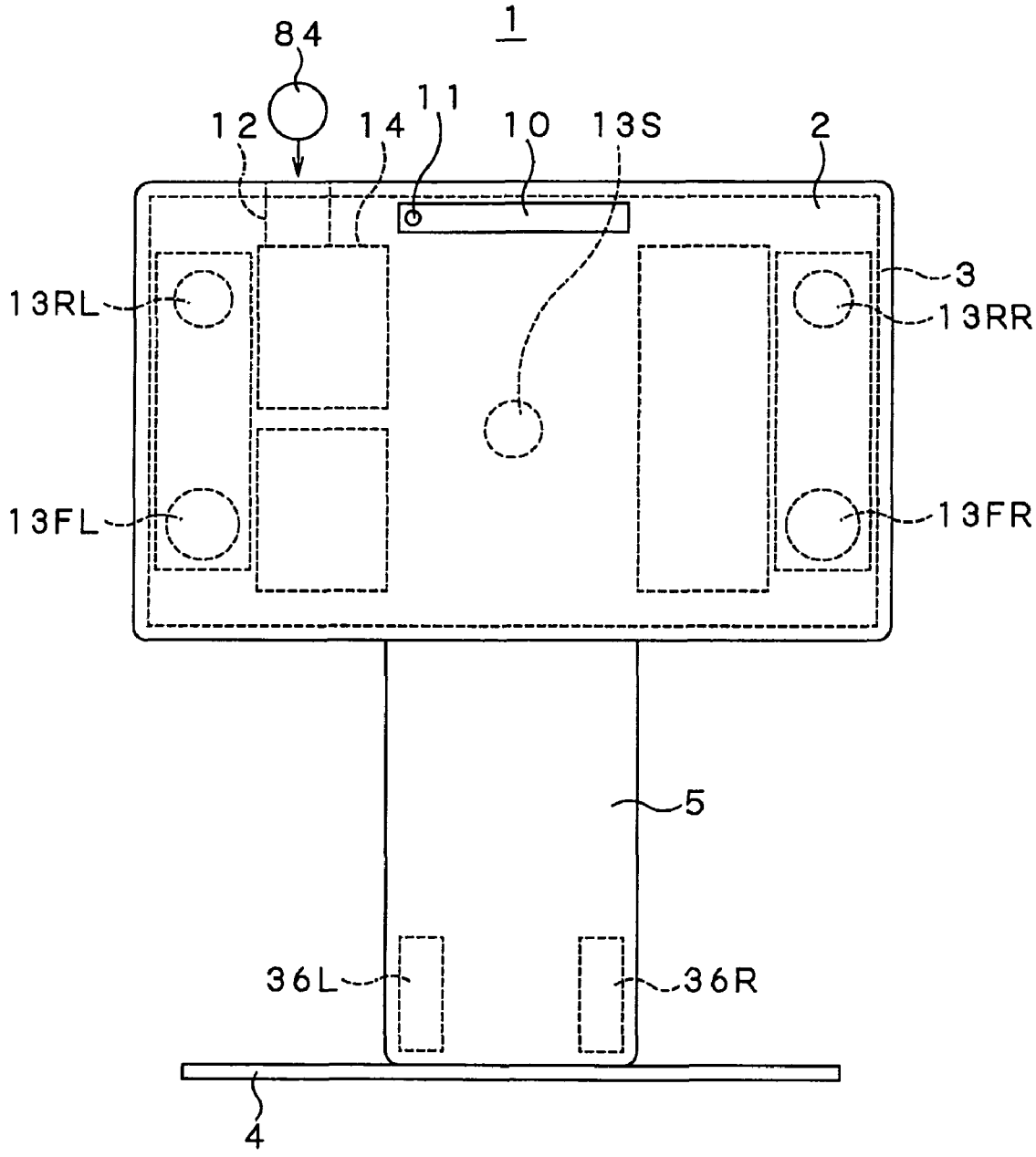
FIG. 2 is a front view of the audio/display apparatus, which shows a second position state in which the audio unit has been moved up to cover over the LCD.

As shown in FIGS. 1 and 2, the audio/display apparatus 1 includes an audio unit 2 and a display unit 3 which are respectively constituted as an independent unit. The audio/display apparatus 1 is roughly constituted by vertically arranging a stand 5, which is integrally formed with a rack 6, on a base 4 and by combining a carrier 7 with the rack 6 such that the carrier 7 is movable with respect to the rack 6. The audio/display apparatus 1 is a stationary type apparatus and installed indoors such as a living room.

The display unit 3 is fixed to the rack 6 at a predetermined level and the audio unit 2 is fixed to the carrier 7. The carrier 7 is moved up and down with respect to the rack 6 by an elevating mechanism 8 to move the audio unit 2 fixed to the carrier 7 in the vertical direction along the front portion of the display unit 3.

The audio unit 2 and display unit 3, which are respectively constituted as an independent unit, are respectively integrated with the carrier 7 and rack 6. Therefore, it is possible to assemble the audio unit 2 and display unit 3, which are originally assembled by processes entirely different from each other, by an audio process and display process, independently, thereby streamlining the entire assembly process, increasing reliability, or reducing manufacturing cost.

In the case where maintenance has to be applied to the audio unit 2 or display unit 3, only one of them can be removed from the carrier 7 or rack 6 for maintenance, thereby streamlining maintenance work. Note that the audio unit 2 and display unit 3 are electrically connected to each other appropriately by a cable or the like in an assembled state.

Figure 5:
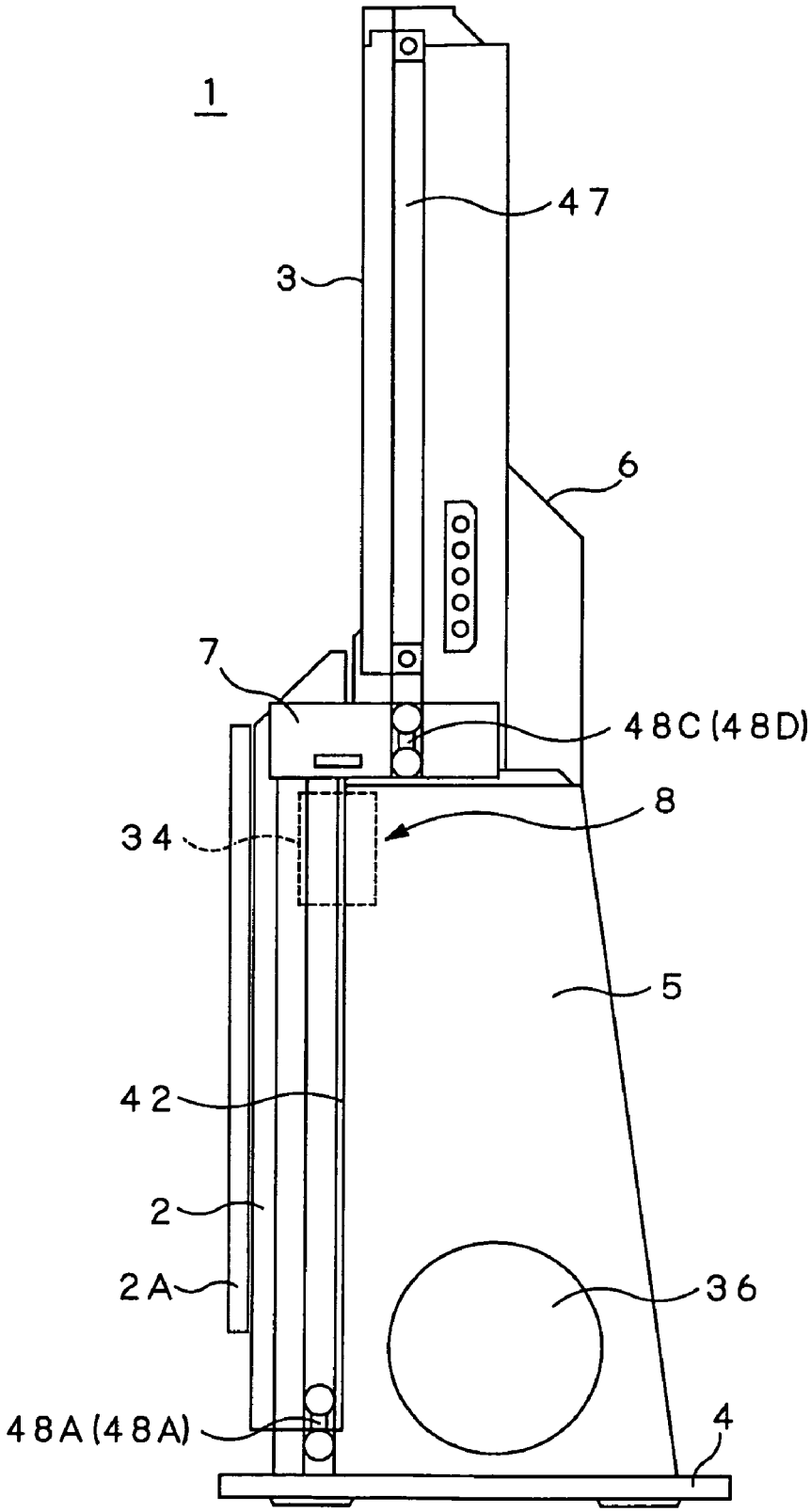
FIG. 5 is a side view showing a state where the audio unit has been moved down to the first position.

When the audio unit 2 has been moved down, the audio/display apparatus 1 is set to a first position at which the display unit 3 is exposed as shown in FIGS. 1 and 5. When the audio unit 2 has been moved up, the audio/display apparatus 1 is set to a second position at which the audio unit 2 covers over the display unit 3 from the front side thereof, as shown in FIG. 2. The audio/display apparatus 1 is moved between the first and second positions according to respective function modes to be described later.

Operations that a user commonly makes for an audio apparatus or TV set, such as power ON/OFF operation, switching operation between audio mode and display mode, switching operation of recording medium, volume control, and channel switching are performed via a remote controller 9. Although not shown, operation switches are appropriately provided in the audio unit 2 and display unit 3 respectively. In the audio/display apparatus 1, the audio unit 2 is moved up and down by a remote control signal from the remote controller 9 or automatically moved up and down by a control signal from a sensor or the like to be described later.

The audio/display apparatus 1 reproduces music broadcasted over a radio received using the audio unit 2 or music information recorded in a recording medium 84. Further, the audio/display apparatus 1 reproduces a video image broadcasted over TV channels received using the display unit 3 or video information recorded in the recording medium 84 and, at this time, outputs a sound signal from the audio unit 2 in accordance with the reproduction of a video image.

As shown in FIGS. 1 and 2, the audio unit 2 is formed into a thin box having a horizontally-rectangular shape and has an overall size large enough to cover over the front surface of the display unit 3 in a state of being moved up to the front of the display unit 3. The audio unit 2 has, at the central upper portion of the main surface thereof, a display area 10 and a light receiver 11 for receiving a remote control signal. Although the details are omitted here, time, calendar, power state, function mode, volume, and the like are displayed in the display area 10. The light receiver 11 is configured to receive a remote control signal transmitted from the remote controller 9.

The audio unit 2 has, at the upper portion of the body thereof, a slot 12 into which the recording medium 84 is inserted. Although only one slot 12 is shown in FIGS. 1 and 2, the audio unit 2 may have a plurality of slots 12 in the case where a plurality of recording media 84 having different sizes are used. Further, the slot 12 may be provided on the side surface of the body.

Figure 3:
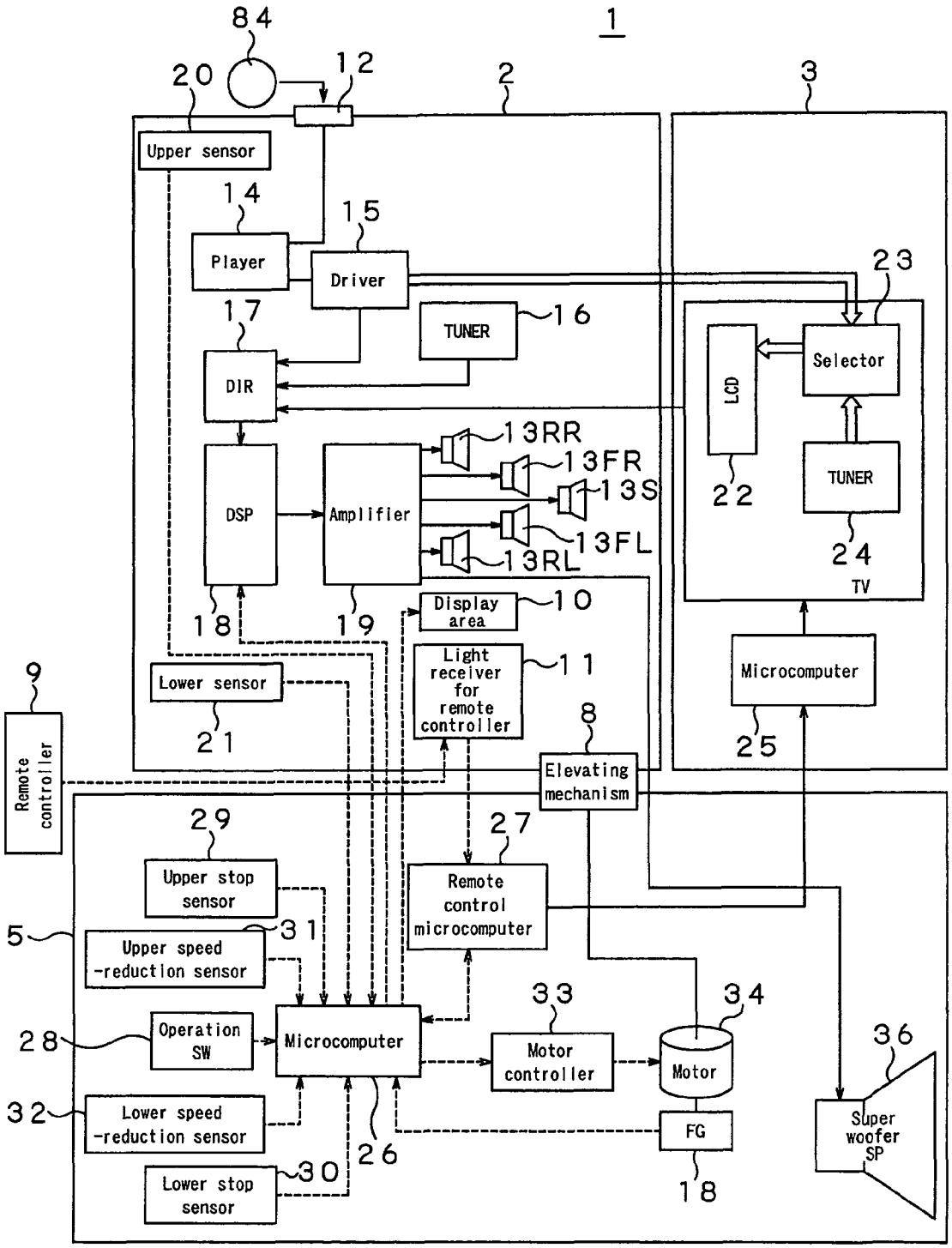
FIG. 3 is a block diagram showing a configuration of the audio/display apparatus.

The audio unit 2 incorporates a pair of rear speakers 13RR, 13RL and a pair of front speakers 13FR, 13FL, and a center speaker 13S (which are hereinafter collectively referred to as "speaker unit 13" except for a case where they are individually described) on both longitudinal sides of the body. Further, as shown in FIG. 3, the audio unit 2 incorporates a player 14 and a driver 15 that constitute a recording medium reproduction section. The recording medium reproduction section drives the recording medium 84 inserted into inside of the body of the audio unit 2 via the slot 12 to reproduce recorded information such as sound information and video information. Further, the audio unit 2 incorporates a tuner 16 for receiving a radio broadcast and the like.

The audio unit 2 further incorporates an input selector/decoder (DIR) 17, a digital signal processor (DSP) 18, and a multichannel amplifier 19. The input selector/decoder (DIR) 17 serves as a sound signal processor that selects a sound signal input from the driver 15, tuner 16, or display unit 3 as well as applies predetermined signal processing to the selected sound signal. The digital signal processor 18 controls the sound image position in the vertical direction in a state where the audio unit 2 has been moved up or down to the first or second position so that sound is output from the speaker unit 13 in satisfactory condition. The multi channel amplifier 19 has a function of supplying a sound signal output from the DSP 18 to the speaker unit 13 at a predetermined signal level.

As described above, the audio unit 2 is moved up and down with respect to the display unit 3 by the elevating mechanism 8. If a foreign matter 71 or the like is introduced in the middle of the elevating operation, components of the audio units may be destroyed. Therefore, in order to detect the introduction of a foreign matter 71, upper and lower sensors 20 and 21 are provided at the upper and lower portions of the audio unit 2, respectively. When the upper sensor 20 or lower sensor 21 detects the introduction of a foreign matter 71, the elevating operation of the audio unit 2 is stopped immediately.

Although the details are omitted, a front panel 2A can be attached to the audio unit 2 in a detachable manner by an appropriate holder structure provided on the front side of the unit body. The front panel 2A is formed by, e.g., a Saran-net (thin and light net) for covering over the inside of the audio unit 2 without impairing sound radiation characteristics of the speaker unit 13. The front panel 2A may be decorated with colored design or graphic design suited to the atmosphere of the room. When the audio unit 2 is set to the second position to cover over the front surface of the display unit 3, the front panel 2A attached to the audio unit 2 may create a unique atmosphere.

The details are omitted here, the display unit 3 has a function equivalent to that of a TV set commonly used as well as a connection function to the audio unit 2. The display unit 3 includes an LCD 22 having a thin and large sized (dozen of inches) screen as a display. The display unit 3 includes, as shown in FIG. 3, a selector 23 for selecting reproduction information output from the driver 15 of the audio unit 2. The display unit 3 further includes a tuner 24 for receiving a TV broadcast. Information of a broadcast program received by the tuner 24 is output to the selector 23. In the display unit 3, video information selected by the selector 23 is supplied to the LCD 22 and the video image is displayed on the display screen of the LCD 22; at the same time, a sound signal is output to the input selector/decoder 17 of the audio unit 2.

The display unit 3 incorporates a microcomputer 25. The microcomputer 25 controls the entire operation of not shown control circuit sections or functional circuit sections. The microcomputer 25 receives a control signal from various operation switches provided in a not shown operation section or a remote control signal from the remote controller 9 and performs predetermined control processing to thereby output a control signal to the respective sections.

As is known, the larger the size of the LCD 22, the more the room atmosphere is impaired because the screen of the LCD 22 stays black in a state where power is turned OFF. According to the present embodiment, the audio unit 2 has been moved up to the second position to be disposed in the front of the display unit 3 to cover over the display surface of the LCD 22, with the result that the black surface of the LCD 22 disappears from a user's sight and, instead, the front panel 2A attached to the audio unit 2 creates a unique atmosphere.

In a state where power is turned ON and a video image is displayed on the LCD 22, heat is generated from a power source circuit and the like in the display unit 3. As is known, when heat is applied from the display screen to the liquid crystal in the LCD 22, it is adversely affected to cause distortion in a video image in some cases. If the audio unit 2 covers over the display surface of the LCD 22 while a video image is being displayed in the LCD 22, generated heat may stay between the audio unit 2 and display unit 3, resulting in high temperature. This heat may degrade the display quality of the LCD 22. Therefore, in the audio/display apparatus 1, the audio unit 2 is kept in the first position in a state where a functional mode where a video image is displayed in the LCD 22 is set.

In the audio/display apparatus 1, the rack 6 supports the display unit 3, which is comparatively heavy, as well as supports, via the carrier 7, the audio unit 2, so that the display unit 3 and audio unit 2 are constituted as one structure having a sufficient mechanical strength, which is vertically arranged on the base 4 by means of the stand 5. The stand 5 is disposed in so-called a dead space between the audio unit 2 and display unit 3, thereby forming comparatively a large space in the inside of the audio/display apparatus 1 to such a degree as not to impair the visual appearance.

Utilizing the space formed by the stand 5, wirings to the audio unit 2 and display unit 3 are provided as well as various sections such as the control circuit section, power source circuit section, and elevating mechanism 8 are provided. Further, the stand 5 incorporates, as shown in FIG. 3, a microcomputer 26 for controlling the entire operation of the audio/display apparatus 1 and a remote control microcomputer 27 for processing a remote control signal which is transmitted from the remote controller 9 and received by the light receiver 11.

The stand 5 further has an operation switch section 28 (the details of which are omitted here) including a main power switch, a volume control switch, and other various switches which are manually operated by a user. The stand 5 further has an upper stop sensor 29, a lower stop sensor 30, an upper speed-reduction sensor 31 and a lower speed-reduction sensor 32. The above sensors 29 to 32 control the operation of the elevating mechanism 8 for moving up and down the audio unit 2. The stand 5 further has a motor controller 33 and drive motor 34 that constitute the elevating mechanism 8 as well as a rotation detection mechanism 35 for detecting the rotational state of the drive motor 34.

Figure 4:
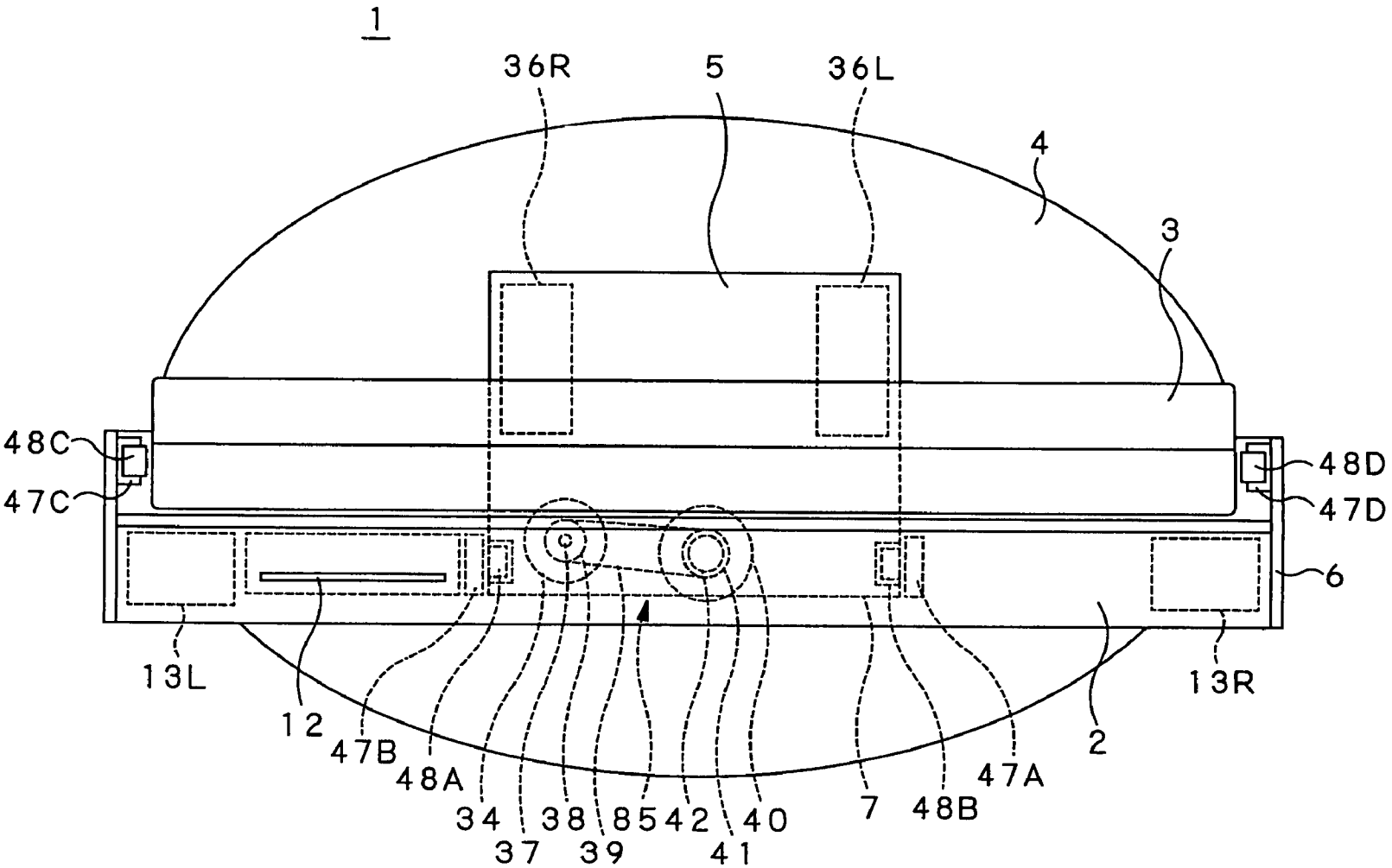
FIG. 4 is a plan view of the audio/display apparatus.

As shown in FIG. 4, the stand 5 incorporates a pair of super woofers 36R, 36L (which are hereinafter collectively referred to as "super woofer 36" except for a case where they are individually described) disposed such that their sound radiating surfaces face outward respectively. The super woofer 36 and speaker unit 13 incorporated in the audio unit 2, (i.e., rear speakers 13RR, 13RL, front speakers 13FR, 13FL, and center speaker 13S) constitute a 5.1 ch surround speaker system. The super woofer 36, which is large and heavy, is not incorporated in the audio unit 2 but in the stand 5, thereby realizing a reduction in weight of the audio unit 2 and improving sound radiation characteristics of the 5.1 ch surround speaker system.

FIG. 3 shows that respective components are incorporated in the audio unit 2, display unit 3, and stand 5. It goes without saying that the configuration of the audio/display apparatus 1 is not limited to this.

As described above, a drive mechanism 85 constituting the drive section of the elevating mechanism 8 is provided in the stand 5. The elevating mechanism 8 is constituted by the drive mechanism 85 and a plurality of guide roller mechanisms 48 for smoothly elevating the carrier 7. As shown in FIG. 4, the drive mechanism 85 is disposed in the carrier 7 that is moved up and down in such a manner that a part thereof projecting in the stand 5.

By incorporating the drive mechanism 85 in the stand 5, it is possible to create a unique impression in terms of the outer appearance of the audio/display apparatus 1 as well as to prevent introduction of a foreign matter, thereby ensuring safety. Thus, the drive mechanism 85 and guide roller mechanisms 48 can move up and down the carrier 7, i.e., audio unit 2 smoothly while reducing occurrence of noise.

The microcomputer 26 receives an operation input signal from the operation switch section 28 or a remote control signal which is transmitted from the remote controller 9 and processed by the remote control microcomputer 27 and, correspondingly, gives a control command to the motor controller 33 to control the operation of the elevating mechanism 8 to thereby move up and down the audio unit 2. Further, the microcomputer 26 determines the vertical position of the audio unit 2 based on detection outputs from the rotation detection mechanism 35 for detecting the rotational state of the drive motor 34 constituting the elevating mechanism 8, upper stop sensor 29, lower stop sensor 30, upper speed-reduction sensor 31, and lower speed-reduction sensor 32 and, correspondingly, gives a control command to the motor controller 33 to control the operation of the elevating mechanism 8.

In the audio/display apparatus 1, the DSP 18 has a role of applying signal processing corresponding to the 5.1 ch surround speaker system constituted by the speaker unit 13 incorporated in the audio unit 2 (i.e., rear speakers 13RR, 13RL, front speakers 13FR, 13FL, and center speaker 13S) and super woofer 36 incorporated in the stand 5 to an audio signal input to the DSP 18 through the input selector/decoder 17. Since the rear speakers 13RR, 13RL are incorporated in the audio unit 2 together with the front speakers 13FR, 13FL, and center speaker 13S, the DSP 18 applies virtual sound-source generation processing to a voice signal to be supplied to the rear speakers 13RR, 13RL to position a virtual sound source on the rear side.

Further, in the audio/display apparatus 1, the microcomputer 26 and DSP 18 apply sound image position correction processing to only voice signals of a front-left channel and a front-right channel to be supplied to the front speakers 13FR, 13FL in accordance with the vertical position of the audio unit 2.

Figure 6:
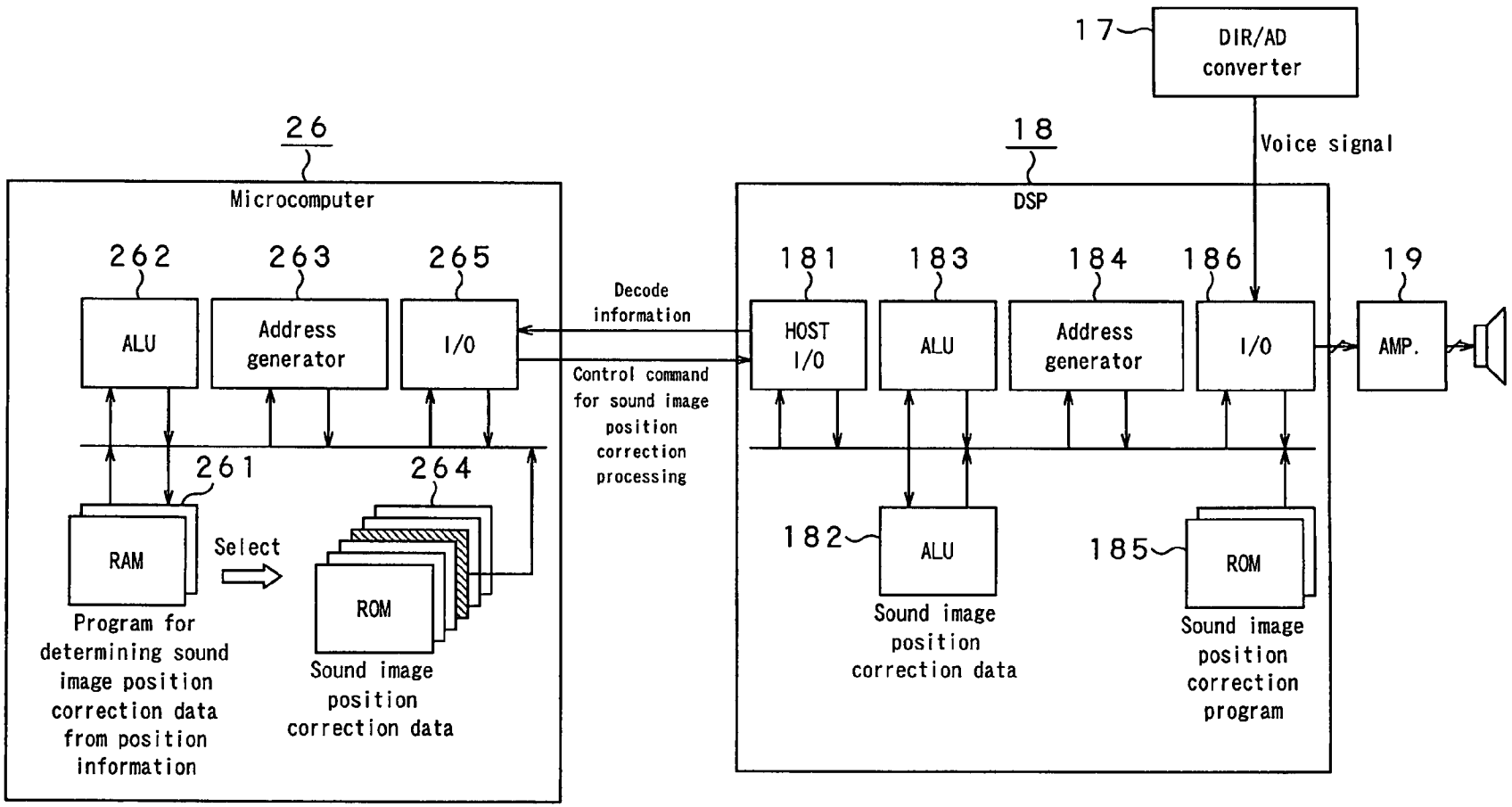
FIG. 6 is a block diagram showing the main configurations of a microcomputer and a DSP for application of sound image position correction processing.

FIG. 6 shows configurations of the microcomputer 26 and DSP 18 for application of the sound image position correction processing.

The microcomputer 26 determines whether the audio unit 2 has been moved down to the first position in which the display unit 3 is exposed based on detection outputs from the upper and lower stop sensors 29 and 30 for detecting the vertical position of the audio unit 2 and supplies sound image position correction data corresponding to the vertical position of the audio unit 2 to the DSP 18.

More specifically, the microcomputer 26 uses an ALU (Arithmetic Logic Unit) 262 to execute a processing program for determining the sound image position correction data from the position information written in a RAM 261, reads out the sound image position correction data from an ROM 264 according to a read-out address generated by an address generator 263, and supplies the readout sound image position correction data to the DSP 18 via an I/O interface 265.

The ROM 264 previously stores sound image position correction data calculated according to an existing method. Although sound image position correction data created based on the basic examination information described in "Spatial Hearing" (written by Jens Blauert, Masayuki Morimoto, and Toshiyuki Goto. 1986, published by Kajima Institute Publishing Co., Ltd.) is used in the present embodiment, the sound image position correction data calculated according to methods described in the abovementioned Patent Documents 1 and 2 may be used.

Further, the microcomputer 26 gives a control command for sound image position correction processing to the DSP 18 and acquires decode information from the DSP 18.

The DSP 18 applies the sound image position correction processing only to voice signals of a front-left channel and a front-right channel to be supplied to the front speakers 13FR, 13FL among audio signals input via the input selector/decoder 17 based on the sound image position correction data received from the microcomputer 26.

Figure 7:
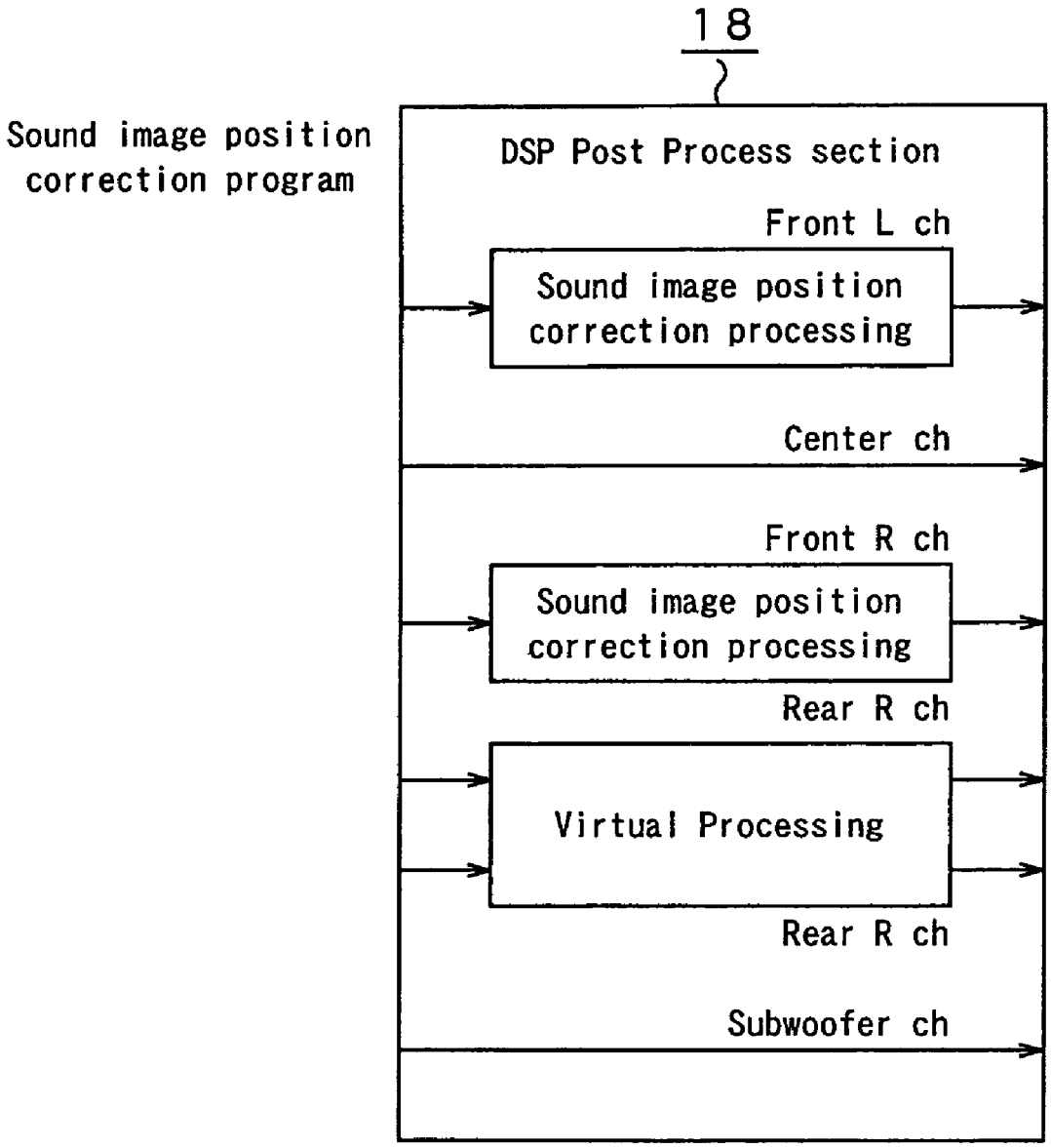
FIG. 7 is a view showing a functional configuration of a sound image position correction program executed by the DSP.

More specifically, upon receiving the sound image position correction data from the microcomputer 26 via the I/O interface 181, the DSP 18 writes the sound image position correction data in the RAM 182. The microcomputer 26 then uses an ALU (Arithmetic Logic Unit) 183 to execute a sound image position correction program written in the ROM 185, reads out the sound image position correction data from the RAM 182 according to a read-out address generated by the address generator 184, and applies the sound image position correction processing only to voice signals of a front-left channel and a front-right channel. FIG. 7 shows a functional configuration of the sound image position correction program executed by the DSP 18.

The audio/display apparatus 1 applies the sound image position correction processing that positions virtual sound sources of front-left and front-right channels so that the position of a sound image produced by the sound output from the 5.1 ch surround speaker system corresponds to the display screen of the display unit 3 when the audio unit 2 has been moved down to the first position at which the display unit 3 is exposed.

The audio/display apparatus 1 applies the virtual sound-source generation processing to a voice signal to be supplied to the rear speakers 13RR, 13RL to position a virtual sound source on the rear side using the DSP 18, so that if the sound image position correction processing is applied also to the voice signal to be supplied to the rear speakers 13RR, 13RL, the image signal may become unnatural. Therefore, the sound image position correction processing is applied only to voice signals of front-left and front-right channels to be supplied to the front speaker 13FR, 13FL among audio signals input via the input selector/decoder 17 based on the sound image position correction data received from the microcomputer 26.

It should be understood by those skilled in the art that various modifications, combinations, sub-combinations and alternations may occur depending on design requirements and other factors insofar as they are within the scope of the appended claims or the equivalents thereof.

What is claimed is:

1. A sound image position correction system which corrects the position of a sound image output from a plurality of speakers in a multichannel reproduction system having three or more channels, comprising:

speaker moving means for moving the positions of the plurality of speakers provided in the multichannel reproduction system;

speaker position detection means for detecting the positions of the plurality of speakers moved by the speaker moving means; and sound image position correction means for applying sound image position correction processing to an electrical sound signal of a channel to be supplied to at least one speaker of the plurality of speakers based on the positions of the speakers detected by the speaker position detection means, wherein the speaker moving means moves the plurality of speakers to a position below and away from a display unit.

2. The sound image position correction system according to claim 1, wherein the sound image position correction means applies sound image position correction processing only to sound signals of front-left and front-right channels.

3. The sound image position correction system according to claim 1, wherein the speaker moving means moves the plurality of speakers at a same time.

4. The sound image position correction system according to claim 1, wherein all of the plurality of speakers are located in a same housing.

5. The sound image position correction system according to claim 4, wherein the housing covers the display unit when the housing is in an uppermost position.

6. The sound image position correction system according to claim 4, wherein the housing contains five speakers.

7. The sound image position correction system according to claim 1, wherein the display unit is connected to a stand which includes additional speakers.

8. An audio/display apparatus including a display unit and a multichannel reproduction system having three or more channels, comprising:

speaker moving means for moving the positions of a plurality of speakers provided in the multichannel reproduction system with respect to the display unit;

speaker position detection means for detecting the positions of the plurality of speakers moved by the speaker moving means; and sound image position correction means for applying sound image position correction processing to an electrical sound signal of a channel to be supplied to at least one speaker of the plurality of speakers based on the positions of the speakers detected by the speaker position detection means, wherein the speaker moving means moves the plurality of speakers to a position below and away from the display unit.

9. The audio/display apparatus according to claim 8, wherein the sound image position correction means applies the sound image position correction processing only to sound signals of front-left and front-right channels so that the position of the sound image corresponds to the display screen of the display unit.

10. The audio/display apparatus according to claim 8, wherein all of the plurality of speakers are located in a same housing.

11. A sound image position correction method performed in a sound image position correction system which corrects the position of a sound image output from a plurality of speakers in a multichannel reproduction system having three or more channels, comprising:

a speaker moving step of moving the positions of the plurality of speakers provided in the multichannel reproduction system to a position below and away from a display unit;

a speaker position detection step of detecting the positions of the plurality of speakers moved by the speaker moving step; and a sound image position correction step of applying sound image position correction processing to an electrical sound signal of a channel to be supplied to at least one speaker of the plurality of speakers based on the positions of the speakers detected by the speaker position detection step.

12. The sound image position correction method according to claim 11, wherein the sound image position correction step applies sound image position correction processing only to sound signals of front-left and front-right channels.

13. The sound image position correction method according to claim 11, wherein all of the plurality of speakers are located in a same housing.

14. A sound image position correction method for an audio/display apparatus including a display unit and a multichannel reproduction system having three or more channels, comprising:

a speaker moving step of moving the positions of the plurality of speakers provided in the multichannel reproduction system with respect to the display unit to a position below and away from the display unit;

a speaker position detection step of detecting the positions of the plurality of speakers moved by the speaker moving step; and a sound image position correction step of applying sound image position correction processing to an electrical sound signal of a channel to be supplied to at least one speaker of the plurality of speakers based on the positions of the speakers detected by the speaker position detection step.

15. The sound image position processing method according to claim 14, wherein the sound image position correction step applies sound image position correction processing only to sound signals of front-left and front-right channels so that the position of the sound image corresponds to the display screen of the display unit.

16. The sound image position correction method according to claim 14, wherein all of the plurality of speakers are located in a same housing.

17. A sound image position correction system which corrects the position of a sound image output from a plurality of speakers in a multichannel reproduction system having three or more channels, comprising:

a speaker moving section that moves the positions of the plurality of speakers provided in the multichannel reproduction system;

a speaker position detection section that detects the positions of the plurality of speakers moved by the speaker moving section; and a sound image position correction section that applies sound image position correction processing to an electrical sound signal of a channel to be supplied to at least one speaker of the plurality of speakers based on the positions of the speakers detected by the speaker position detection section, wherein the speaker moving section moves the plurality of speakers to a position below and away from a display unit.

18. The sound image position correction system according to claim 17, wherein all of the plurality of speakers are located in a same housing.

19. An audio/display apparatus including a display unit and a multichannel reproduction system having three or more channels, comprising:

a speaker moving section that moves the positions of a plurality of speakers provided in the multichannel reproduction system with respect to the display unit;

a speaker position detection section that detects the positions of the plurality of speakers moved by the speaker moving section; and a sound image position correction section that applies sound image position correction processing to an electrical sound signal of a channel to be supplied to at least one speaker of the plurality of speakers based on the positions of the speakers detected by the speaker position detection section, wherein the speaker moving section moves the plurality of speakers to a position below and away from the display unit.

20. The audio/display apparatus according to claim 19, wherein all of the plurality of speakers are located in a same housing.

* * * * *